United States Patent [19]

St. Pierre et al.

[11] 4,400,069

[45] Aug. 23, 1983

[54] PHOTOTYPESETTER FONT DISK

[75] Inventors: Alfred J. St. Pierre, West Boxford, Mass.; Dann Darnstaedt, Kingston, N.H.; Laurence S. Blake, West Peabody, Mass.

[73] Assignee: Compugraphic Corporation, Wilmington, Mass.

[21] Appl. No.: 264,620

[22] Filed: May 15, 1981

[51] Int. Cl.[3] ..... B41B 17/32; B41B 17/42

[52] U.S. Cl. ..... 354/11; 354/15

[58] Field of Search ..... 354/5, 11, 12, 13, 14, 354/15, 16, 18, 19, 292

[56] References Cited

U.S. PATENT DOCUMENTS

| | | | |
|---|---|---|---|
| 3,543,657 | 12/1970 | Rosenblum | 354/16 |
| 3,610,121 | 10/1971 | Hanson et al. | 354/15 |
| 3,710,707 | 1/1973 | Hanson et al. | 354/15 |
| 3,733,977 | 5/1973 | Morgan | 354/15 |
| 3,921,182 | 11/1975 | Hanson et al. | 354/15 |
| 4,027,313 | 5/1977 | Klepper et al. | 354/15 |
| 4,168,889 | 9/1979 | Norris | 354/16 |

*Primary Examiner*—Russell E. Adams

*Attorney, Agent, or Firm*—Richard J. Birch

[57] ABSTRACT

A phototypesetter font disk has a plurality of circumferentially spaced, optically readable indicia and a strobe track radially spaced from the indicia which contains a plurality of circumferentially spaced timing marks. Each indicia has an associated timing mark that is both radially and circumferentially spaced from its respective indicia. The strobe track has an identifiable reference location from which each indicia timing mark is angularly spaced. Additional marks are interposed between the indicia timing marks on the strobe track to define digital data relating to the font disk. Typically, such data includes font identification information.

17 Claims, 5 Drawing Figures

PHOTOTYPESETTER FONT DISK

BACKGROUND OF THE INVENTION

The present invention relates to font disks for phototypesetters and, more particularly, to an improved font disk having indicia or characters and a strobe timing track that contains both timing marks for the indicia and digitally encoded data for the particular font disk.

Phototypesetters and optically readable font disks therefor are well known in the art. Representative examples of commercially available phototypesetters include Mergenthaler (Linstron Model 202) and AM International Model 4800. The patent literature describes a variety of phototypesetters and their associated optically readable font disks. See for example U.S. Pat. Nos. 2,787,199 and 3,896,454 for phototypesetting apparatus and 2,888,865, 3,821,770, 3,972,054 and 4,119,977 for examples of optically readable font disks for phototypesetters.

In addition to describing a phototypesetting apparatus, U.S. Pat. No. 3,896,454 also illustrates a font disk having alphabetic characters or other indicia arranged in concentric circles on the disk. Each character is identified by a number expressed in binary code. The binary code character information is carried in a ring on the disk with the binary number for each character being located 180 degrees from its associated character. In addition to the binary coded character information, the disk also carries four rings of marks which are associated with the characters located 180 degrees from the respective marks and which indicate the width of the respective characters. A pulse mark is provided for each character on the disk with the leading edge of the pulse mark determining the firing of the strobe light for the typesetter.

Although U.S. Pat. No. 3,896,454 depicts binary coded character information on a font disk, the character information is independent of and physically removed from the timing pulses of the strobe track. This configuration is wasteful of disk area and limits the number of font tracks that can be placed on a given font disk.

It is accordingly, a general object of the invention to provide an improved font disk for a phototypesetter.

It is a specific object of the invention to provide a phototypesetter font disk in which font information or other data is integrated with and contained within the timing or strobe track of the font disk.

It is another object of the invention to provide digitally encoded data pulses in the font disk strobe track between timing strobe marks for the font characters.

It is still another object of the present invention to provide a phototypesetter font disk in which character validation data is encoded within and forms a part of the timing strobe track.

It is a further object of the invention to provide a font disk having font identification data encoded within the timing strobe track of the font disk.

It is a feature of the invention that other font information such as, character width values, Kerning values and other character attributes can be digitally encoded in the timing strobe track of the font disk.

BRIEF DESCRIPTION OF THE DRAWINGS

These objects and other objects and features of the invention will best be understood from a detailed description of a preferred embodiment thereof, selected for purposes of illustration and shown in the accompanying drawings, in which.

DETAILED DESCRIPTION OF A PREFERRED EMBODIMENT

Figure 1:
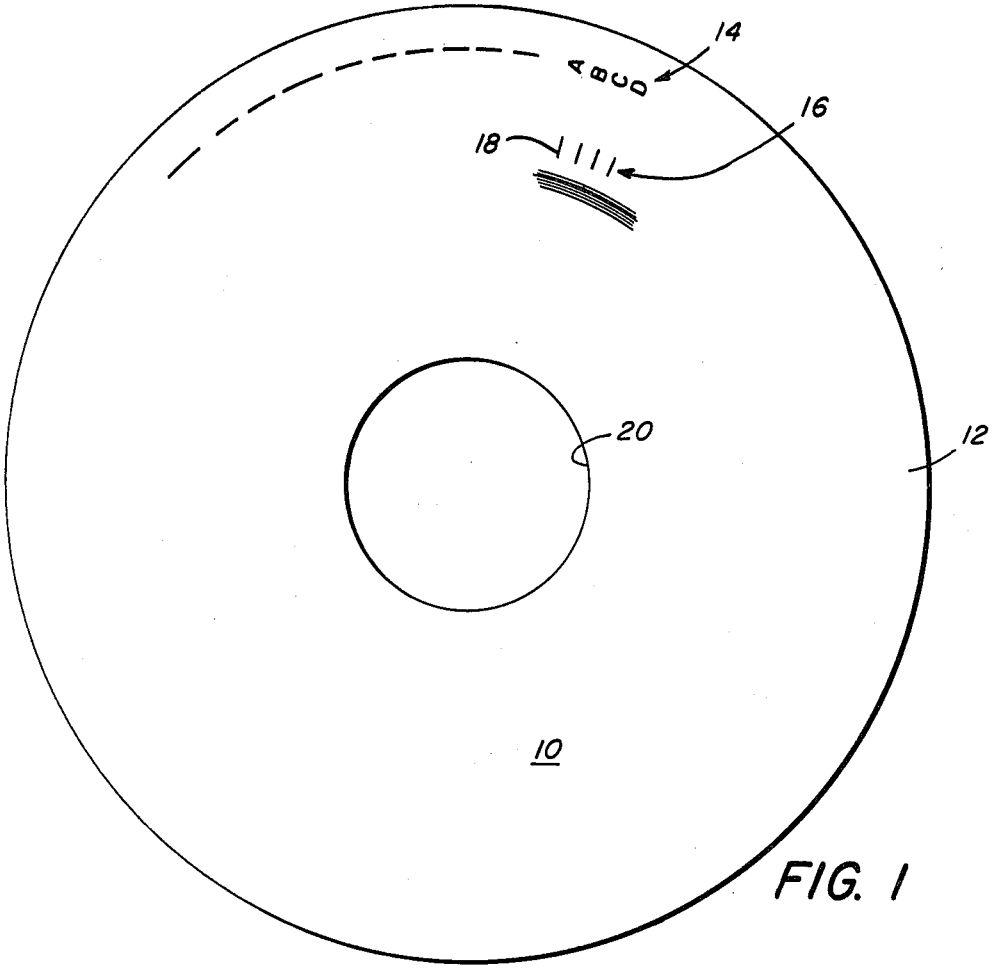
FIG. 1 is a plan view of a font disk constructed in accordance with the present invention.
Figure 2:
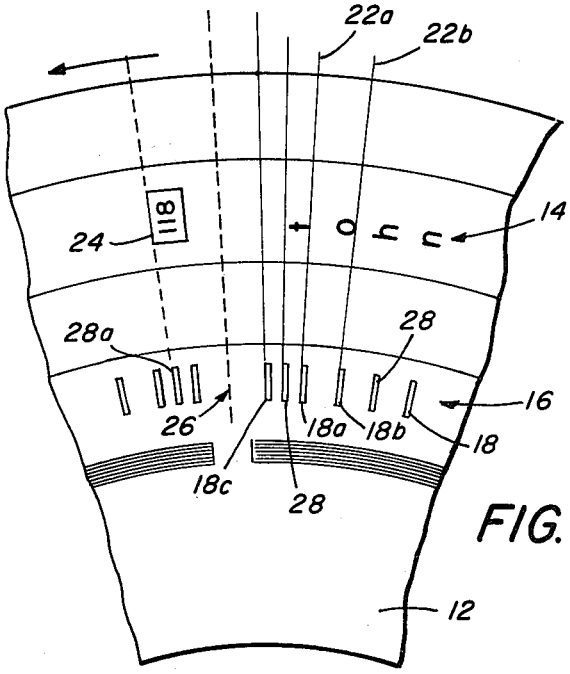
FIG. 2 is an enlarged view of a portion of the font disk shown in FIG. 1.
Figure 3:
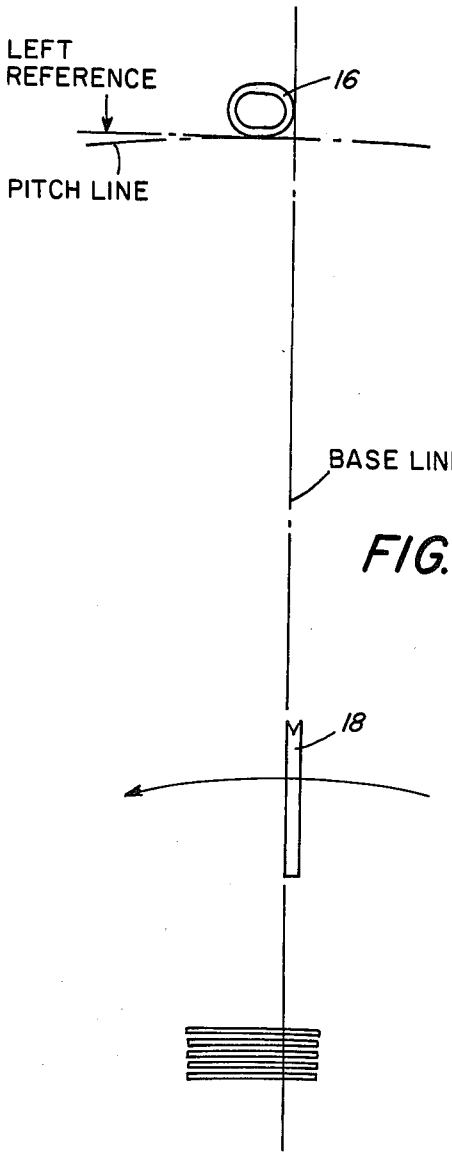
FIG. 3 is a still further enlarged view of a portion of the font disk of FIGS. 1 and 2 illustrating the relationship of a font character to its associated strobe timing mark.

Turning now to the drawings, and particularly to FIGS. 1 through 3 thereof, there is shown a font disk constructed in accordance with the present invention and indicated generally by the reference numeral 10. Font disk 10 is generally circular in configuration with a substrate 12 having a plurality of indicia 14 such as letters, numbers and graphics formed thereon by known photographic processess. The indicia are arranged in a circular array with suitable circumferential spacing between adjacent indicia (hereinafter called "characters"). The font disk substrate 12 can be flexible or rigid as desired. Typically, the flexible substrate comprises a photographic film while the rigid substrate is formed from glass or any other suitably rigid material.

The font disk 10 has a strobe timing track 16 that contains a plurality of timing marks 18 that are used in a conventional manner to control the firing of a phototypesetter strobe lamp (not shown). The timing marks 18, shown in greater detail in FIG. 2, are circumferentially spaced within the strobe timing track 16 and are radially spaced from their associated indicia or characters 14. The strobe timing track can be located either radially outside of the indicia 14 or inwardly thereof as shown in the drawings.

The font disk substrate 12 can be formed either as a single layer or as a plurality of layers assembled in sandwiched relation. The previously mentioned indicia 14 and strobe timing track 16 can be located on the same or different layers of the substrate. Therefore, as used herein, the term "disk substrate" shall include both a single layer substrate and a plural layer substrate in which the substrate layers (or separate disks) are rotatable as a unit.

For purposes of illustration and convenience of description, the indicia and timing marks shown on the font disk of FIG. 1 are shown as a dark area while the substrate 12 is shown as a light area. It will be understood that typically the font disk indicia and timing marks are transparent to light while the substrate 12 is opaque. This so-called "negative" relationship is normally employed in a phototypesetter. However, the converse or "positive" arrangement of opaque indicia and timing marks and a transparent substrate "background" also can be employed as well as any combination of "negative" and "positive" areas on the disk. It will be appreciated that the font disk and its indicia and timing marks can be formed as light-reflecting elements as well as light-transmitting and blocking elements.

The font disk 10 has a central mounting hole 20 for engagement with the drive spindle (not shown) of a phototypesetter. During operation of the phototypesetter, the disk is rotated by the typesetter's drive spindle so that the typesetter's strobe lamp can fire at an appropriate time to illuminate a preselected indicia or character 14. Control of the strobe lamp firing is performed in a known manner through the use of the associated strobe timing marks 18.

The relationship of the strobe timing marks 18 and characters 14 can best be seen in the enlarged views of FIGS. 2 and 3 in which the arrow indicates the direction of rotation of the font disk. Looking at FIG. 2, the characters are depicted as a solid dark area while the associated timing marks 16 are shown as white or transparent areas. It will be appreciated from the discussion above that this arrangement is used merely for purposes of illustration and that typically both the font disk timing marks 16 and characters 14 are formed as transparent areas on an opaque background as shown in FIG. 3.

The font characters 14 are arranged in an annular array on the font disk. Each one of the circumferentially spaced characters 14 has its own associated timing mark. It can be seen in FIG. 2 that the letter "t" has a timing mark 18*a* and the letter "o" has another timing mark 18*b*. When viewed in terms of disk rotation, the leading edge of each timing mark corresponds to the base of its associated character. This relationship is shown by the base line 22*a* for the letter "t" and the base line 22*b* for the letter "o" in FIG. 2 and in enlarged detail in FIG. 3.

The position of a preselected character on the font disk can be expressed in terms of its angular distance from a zero or reference position on the disk. This angular distance is represented by the number of timing marks that occur between the reference position and the character. During rotation of the font disk, detection of the actual position of a preselected character is accomplished by counting the number of timing marks from the reference position to the desired character. It will be appreciated that this count is independent of the rotational velocity of the font disk.

For purposes of illustration, the font shown in FIG. 2 contains one hundred and eighteen characters with the 118th character identified by the numeral block 24. The number of timing marks on the font disk is determined by the number of font characters +N where "N" is one or more. As shown in the example of FIG. 2, there are one hundred and nineteen timing marks 18 and one blank timing mark location 26 for the one hundred and eighteen character font. Thus, the font disk 10 is divided into one hundred and twenty segments each having a nominal angular width of three degrees.

The first one of the one hundred and nineteen timing marks occurs immediately after the zero or reference position identified by blank timing mark location 26. Given the counterclockwise rotation of the font disk shown in FIG. 2, this first timing mark is identified as mark 18*c*. The next or second timing mark 18*a* is associated with the first font character, in this case, the letter "t". Similarly, the third timing mark 18*b* is associated with the second letter "o". The relationship of the timing mark and character numbers is illustrated in the timing diagram of FIG. 4 where timing mark #119 is associated with character #118 and timing mark #2 with character #1, etc. This arrangement permits a "pre-loading" or arming of the typesetter strobe lamp circuit before the preselected character reaches the strobe firing position.

It has already been mentioned that the timing strobe track 16 contains digitally encoded data associated with a particular font. Looking at FIGS. 2 and 4, the data is encoded by means of data marks 28 located between the character timing marks 18. In the preferred embodiment, sixty-four data bit locations are provided with the last data bit location shown by the data mark 28*a* in FIG. 2. The timing marks and/or data marks can be formed as light transmitting or light reflecting areas or formed as a magnetic pattern on a suitable magnetic recording media located on the substrate 12 or on a separate disk (not shown) that rotates with the font disk. The relationship of the timing marks and data marks is depected in the timing diagram of FIG. 4.

The data marks 28 can be used for a variety of purposes. For example, the marks provide a way of identifying the particular font. They also can be used to determine the integrity of the font disk data and the condition of the font disk strobe timing track. Since the data and timing marks occur at known angular locations on the font disk, the presence or absence of such marks (or the presence of extraneous marks e.g., scratches, at other locations in the strobe timing track) provide an indication of the physical condition of the font disk and the integrity of the font data. In addition to these uses, it will be understood that once the font identification data has been optically read, this data can be used to access other data that is related to the specific font disk, but is not present on the disk itself.

Figure 4:
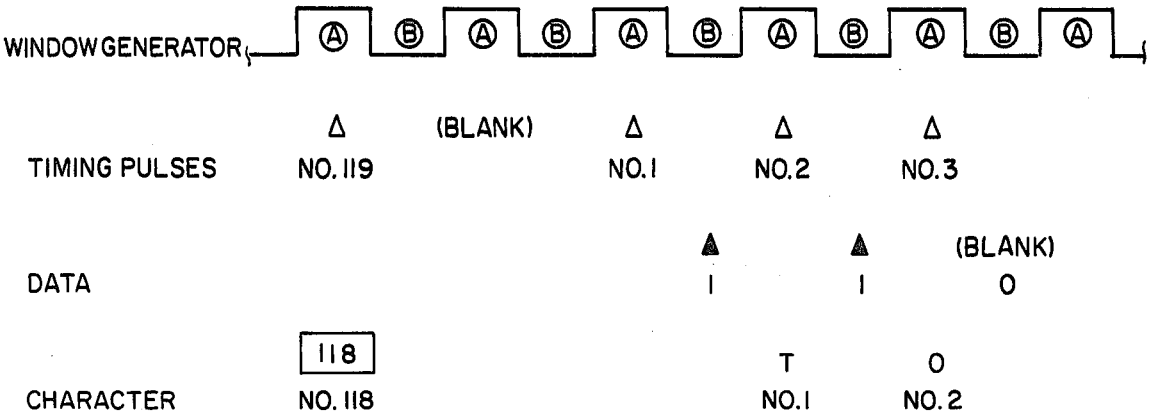
FIG. 4 is a simplified timing diagram showing the relationship of the timing pulses and the data pulses with respect to the font characters; and, FIG. 5 is a block diagram of the circuitry used to provide data separation of the font information from the timing information contained in the font disk timing strobe track.
Figure 5:
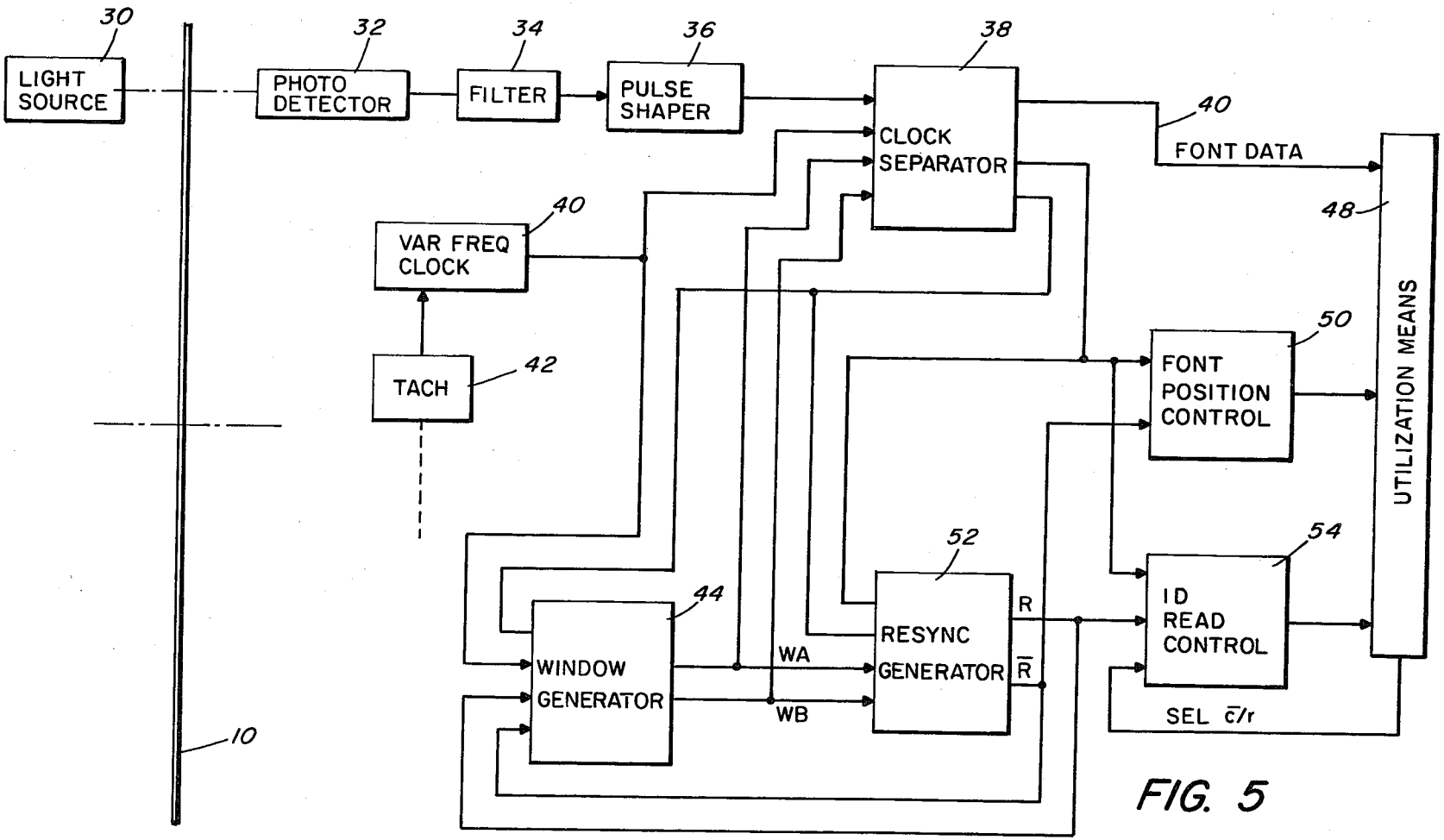

Separation of the timing and data information is accomplished by the apparatus and circuitry is shown diagrammatically and in block form in FIG. 5. Looking at FIG. 5 and the associated timing diagram of FIG. 4, the font disk 10 is positioned between a light source 30 and a photodetector 32 so that light from source 30 will be intercepted by or transmitted through the rotating font disk to the photodetector. The photodetector 32 produces an output pulse in response to each timing mark 18 and data mark 28. The timing and data mark pulse stream from photodetector 32 is filtered for transmission noise by filter 34. The pulses are then limited in width by pulse shaper 36 before being applied as one input to a clock separator 38. A second input signal to clock separator 38 is provided by a variable frequency clock 40. The frequency of the variable frequency clock 40 is determined by the output from a tachometer 42 that reads the rotational speed of the font disk 10. Alternatively, the variable frequency clock pulses can be provided by utilization means 48 with the frequency of the pulses being a function of the average rotational velocity of the font disk.

The output from the variable frequency clock also is applied as one input to a window generator 44 that produces a square wave output as shown in FIG. 4. The square wave output from window generator 44 defines two information windows: a timing pulse window "WA" and a data pulse window "WB". These windows are identified in FIG. 4 by the encircled letters "A" and "B". The "A" and "B" window square waves are applied as the third and fourth inputs, respectively, to the previously mentioned clock separator 38.

The clock separator 38 separates the timing and data pulses produced from the corresponding font disk timing and data marks so that data pulses occurring during window "B" are outputted on font data line 46 to a utilization means 48 such as, a phototypesetter. During timing pulse window "A", the output from clock separator 38 is applied to a font position control 50. The font position control 50 operates as a counter to accumulate the number of timing pulses that have occured during the "A" window time frames. The output from the font position control counter is used to control the flashing of the phototypesetter strobe lamp.

The output from clock separator 38 also is applied as an input to the previously mentioned window generator 44. The two remaining inputs to window generator 44 are derived from a resynchronization generator 52 that detects the missing timing mark at location 26 on the font disk (FIG. 2). The resync signal is used to force the window generator 44 into the window "A" or timing pulse window condition. The first timing pulse detected after this occurance resets the resync generator and allows the window generator to run freely for the remainder of the font disk revolution. The window generator alternately generates windows "A" and "B" until the next blank timing pulse location is detected. The width of windows "A" and "B" is governed by the rotational speed of the font disk through the use of the previously mentioned variable frequency clock 40.

If desired, reading of the font data into the utilization means can be governed by means of an identification read control 54. The ID read control 54 has as inputs the timing mark pulses from the clock separator and the "R" output from the resync generator. Selection of the appropriate input is determined by a control signal "select c/r" from the utilization means.

Having described in detail a preferred embodiment of our invention, it will now be apparent to those skilled in the art that numerous modifications can be made therein without departing from the scope of the invention as defined in the following claims.

What we claim and desire to secure by Letters Patent of the United States is:

1. A phototypesetter font disk comprising:

a disk substrate;

a plurality of indicia positioned on said disk substrate in an annular array with each indicia being circumferentially spaced from an adjacent indicia;

a plurality of circumferentially spaced timing marks positioned on said disk substrate in an annular array that defines a strobe timing track, said timing marks each being located at a predetermined position with respect to an associated indicia;

a plurality of circumferentially spaced data marks located within said strobe timing track with the data marks being positioned between the timing marks, said data marks representing font disk identification information in digital form;

means responsive to said spaced timing marks and spaced data marks in said strobe timing track for producing signals representative of the presence and absence of said timing and data marks at a selected location with respect to said annular array that defines the strobe timing track;

means responsive to said signals for separating the signals into timing marks signals and font disk information signals; and, utilization means responsive to said font disk information signals.

2. A phototypesetter font disk comprising:

a disk substrate;

a plurality of indicia positioned on said disk substrate in an annular array with each indicia being circumferentially spaced from an adjacent indicia;

a disk reference mark located on said disk; and, a plurality of circumferentially spaced marks positioned on said disk substrate in an annular array that defines a single track of font disk data in digital form with at least one portion of said circumferentially spaced marks constituting strobe timing marks that are each located at a predetermined position with respect to an associated indicia and with respect to said disk reference mark and with another portion of said circumferentially spaced marks constituting font disk information in digital form, said circumferentially spaced marks of said another portion each being located between strobe timing marks and at a predetermined position with respect to said disk reference mark whereby the strobe timing marks can be distinguished from the marks constituting the font disk information by means of the angular distance of each mark from the reference mark.

3. The phototypesetter font disk of claim 2 wherein the number of strobe timing marks is equal to the number of indicia+N where N is one or more.

4. The phototypesetter font disk of claim 2 wherein the number of strobe timing mark locations is equal to the number of indicia plus two or more.

5. The font disk of claim 4 wherein a strobe timing mark is absent in at least one of said strobe timing mark locations.

6. An optically readable phototypesetter font disk comprising:

a disk substrate;

a plurality of light modifying indicia positioned on said disk substrate in an annular array with each indicia being circumferentially spaced from an adjacent indicia;

a disk reference mark located on said disk; and, a plurality of circumferentially spaced marks positioned on said disk substrate in an annular array that defines a single track of font disk data in digital form with at least one portion of said circumferentially spaced marks constituting strobe timing marks that are each located at a predetermined position with respect to an associated indicia and with respect to said disk reference mark and with another portion of said circumferentially spaced marks constituting font disk information in digital form, said circumferentially spaced marks of said another portion each being located between strobe timing marks and at a predetermined position with respect to said disk reference mark whereby the strobe timing marks can be distinguished from the marks constituting the font disk information by means of the angular distance of each mark from the reference mark.

7. The optically readable phototypesetter font disk of claim 6 wherein the disk substrate is flexible.

8. The optically readable phototypesetter font disk of claim 6 wherein the disk substrate is solid.

9. An optically readable phototypesetter font disk comprising:

a disk substrate;

a plurality of light reflecting indicia positioned on said disk substrate in an annular array with each indicia being circumferentially spaced from an adjacent indicia;

a disk reference mark located on said disk; and, a plurality of circumferentially spaced marks positioned on said disk substrate in an annular array that defines a single track of font disk data in digital form with at least one portion of said circumferentially spaced marks constituting strobe timing marks that are each located at a predetermined position with respect to an associated indicia and with respect to said disk reference mark and with another portion of said circumferentially spaced marks constituting font disk information in digital form, said circumferentially spaced marks of said another portion each being located between strobe timing marks and at a predetermined position with respect to said disk reference mark whereby the strobe timing marks can be distinguished from the marks constituting the font disk information by means of the angular distance of each mark from the reference mark.

10. The optically readable phototypesetter font disk of claim 9 wherein the disk substrate is flexible.

11. The optically readable phototypesetter font disk of claim 9 wherein the disk substrate is solid.

12. An optically readable phototypesetter font disk comprising:

a disk substrate;

a plurality of light transmitting indicia positioned on said disk substrate in an annular array with each indicia being circumferentially spaced from an adjacent indicia;

a disk reference mark located on said disk; and, a plurality of circumferentially spaced marks positioned on said disk substrate in an annular array that defines a single track of font disk data in digital form with at least one portion of said circumferentially spaced marks constituting strobe timing marks that are each located at a predetermined position with respect to an associated indicia and with respect to said disk reference mark and with another portion of said circumferentially spaced marks constituting font disk information in digital form, said circumferentially spaced marks of said another portion being located between strobe timing marks and at a predetermined position with respect to said disk reference mark whereby the strobe timing marks can be distinguished from the marks constituting the font disk information by means of the angular distance of each mark from the reference mark.

13. The optically readable phototypesetter font disk of claim 12 wherein the disk substrate is flexible.

14. The optically readable phototypesetter font disk of claim 12 wherein the disk substrate is solid.

15. A phototypesetting apparatus comprising:

a disk substrate;

a plurality of indicia positioned on said disk substrate in an annular array with each indicia being circumferentially spaced from an adjacent indicia;

a plurality of circumferentially spaced timing marks positioned on said disk substrate in an annular array that defines a strobe timing track, said timing marks each being located at a predetermined position with respect to an associated indicia and with the number of timing marks being equal to the number of indicia+N where N is one or more;

a plurality of circumferentially spaced data marks located within said strobe timing track with the data marks being positioned between the timing marks, said data marks representing font disk information in digital form;

means responsive to said spaced timing marks and spaced data marks in said strobe timing track for producing signals representative of the presence and absence of said timing and data marks at a selected location with respect to said annular array that defines the strobe timing track;

means responsive to said signals for separating the signals into timing marks signals and font disk information signals; and, utilization means responsive to said font disk information signals.

16. A phototypesetting apparatus comprising:

a disk substrate;

a plurality of indicia positioned on said disk substrate in an annular array with each indicia being circumferentially spaced from an adjacent indicia;

a plurality of circumferentially spaced timing marks positioned on said disk substrate in an annular array that defines a strobe timing track, said timing marks each being located at a predetermined position with respect to an associated indicia and with said strobe timing track having a number of timing mark locations equal to the number of indicia plus two or more;

a plurality of circumferentially spaced data marks located within said strobe timing track with the data marks being positioned between the timing marks, said data marks representing font disk information in digital form;

means responsive to said spaced timing mark and spaced data marks in said strobe timing track for producing signals representative of the presence and absence of said timing and data marks at a selected location with respect to said annular array that defines the strobe timing track;

means responsive to said signals for separating the signals into timing marks signals and font disk information signals; and, utilization means responsive to said font disk information signals.

17. A phototypesetting apparatus comprising:

a disk substrate;

a plurality of light modifying indicia positioned on said disk substrate in an annular array with each indicia being circumferentially spaced from an adjacent indicia;

a plurality of circumferentially spaced timing marks positioned on said disk substrate in an annular array that defines a strobe timing track, said timing marks each being located at a predetermined position with respect to an associated indicia;

a plurality of circumferentially spaced data marks located within said strobe timing track with the data marks being positioned between the timing marks, said data marks representing font disk information in digital form;

means responsive to said spaced timing marks and spaced data marks in said strobe timing track for producing signals representative of the presence and absence of said timing and data marks at a selected location with respect to said annular array that defines the strobe timing track;

means responsive to said signals for separating the signals into timing marks signals and font disk information signals; and, utilization means responsive to said font disk information signals.

* * * * *